US005735454A

United States Patent [19]

Jensen

[11] Patent Number: 5,735,454

[45] Date of Patent: Apr. 7, 1998

[54] COHESIVE SELF LATCHING TRAYS

[75] Inventor: Kurt D. Jensen, Cincinnati, Ohio

[73] Assignee: International Paper Company, Purchase, N.Y.

[21] Appl. No.: 655,589

[22] Filed: May 30, 1996

[51] Int. Cl.[6] ..... B65D 5/42

[52] U.S. Cl. ..... 229/123.1; 229/125.35; 229/160.2; 229/901

[58] Field of Search ..... 229/123.1, 125.33, 229/125.34, 125.35, 160.2, 248, 901; 220/359, 4.21, 4.24; 383/35

[56] References Cited

U.S. PATENT DOCUMENTS

| | | | |
|---|---|---|---|
| 2,917,218 | 12/1959 | Guyer . | |
| 2,969,904 | 1/1961 | Cottrill | 229/248 |
| 2,970,525 | 2/1961 | Klein et al. | 229/160.2 |
| 2,986,322 | 5/1961 | Atkinson | 229/160.2 |
| 3,056,245 | 10/1962 | Baum . | |
| 3,176,900 | 4/1965 | Ciganenko . | |
| 3,300,117 | 1/1967 | Kossnar | 229/125.35 |
| 4,076,168 | 2/1978 | Ferri . | |
| 4,241,863 | 12/1980 | Faller | 229/125.35 |
| 4,261,504 | 4/1981 | Cowan | 229/123.1 |
| 4,333,569 | 6/1982 | Hammacher . | |
| 4,804,137 | 2/1989 | Harby . | |

FOREIGN PATENT DOCUMENTS

| | | | |
|---|---|---|---|
| 496974 | 10/1953 | Canada | 383/35 |
| 1652207 | 5/1991 | U.S.S.R. | 383/35 |
| 1822842 | 6/1993 | U.S.S.R. | 383/35 |
| 128 | 1/1897 | United Kingdom | 383/35 |

OTHER PUBLICATIONS

The Wiley Encylcopedia of Packaging Technology, John Wiley & Sons (1986), p. 458.

*Primary Examiner*—Gary E. Elkins
*Attorney, Agent, or Firm*—Michael J. Doyle

[57] ABSTRACT

A container formed of two identical trays. Each tray carries two flanges, the flanges extending from opposite side walls of a tray. One surface of each flange is provided with a layer or coating of a cohesive material. Such a material adheres only to other cohesive surfaces. Storage of the coated blanks, and of the erected trays, is hence facilitated. The container is particularly useful for the packaging of fast food items.

8 Claims, 4 Drawing Sheets

FIG 6
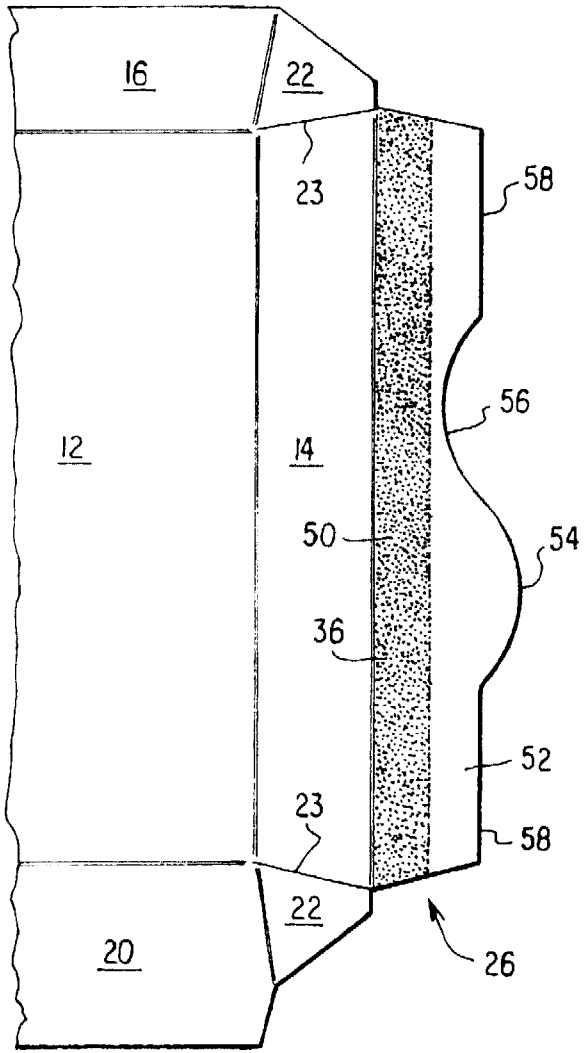
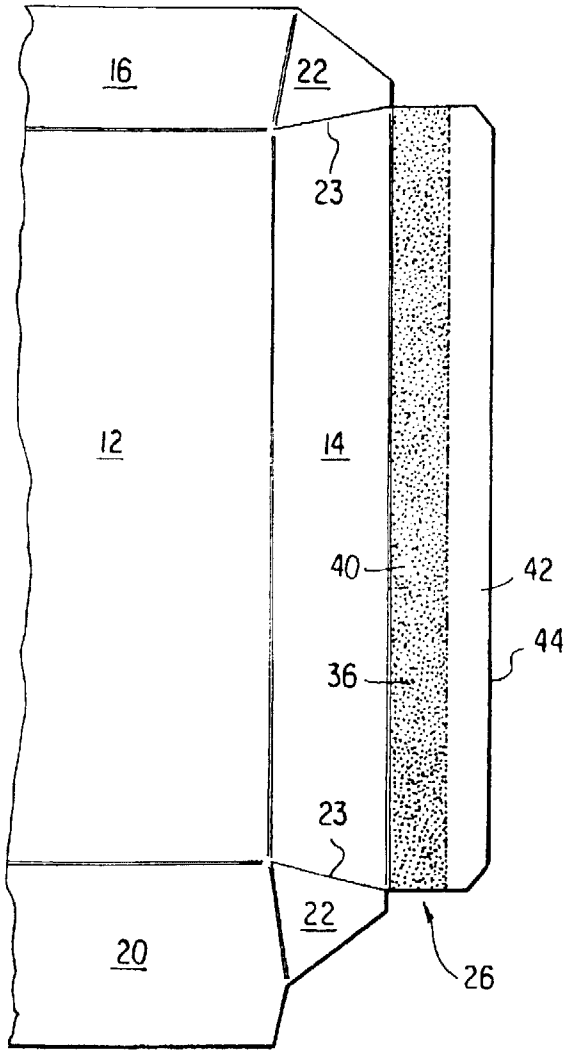
FIG 5

COHESIVE SELF LATCHING TRAYS

BACKGROUND OF THE INVENTION

This invention relates to a paperboard container and more particularly to a paperboard container formed by juxtaposing together two trays of similar construction.

The container field is aware of composite containers formed by placing identical trays together, the trays having some means for securing them to maintain the integrity of the container. The trays may be maintained together by means of adhesive or staples or the like, such as disclosed at FIGS. 5 and 6 of U.S. Pat. No. 4,076,168 issued to Ferri, or they may be maintained together by means of an integral hinge between corresponding rear walls of the trays, with some latch arrangement at those side walls of the tray opposite the rear wall. These latter containers are known as clamshell containers.

While such known constructions have generally proved generally satisfactory for their intended purposes, such as the packaging of fast food or other food items, for example, they display certain drawbacks. For example, if an adhesive or staple is used to maintain the trays together, such as in the noted Ferri construction, then if upon initial opening of the container its contents are only partially consumed, then the container cannot be reassembled by placing the trays together. Namely, once the original staples have been removed, or seals have been opened to obtain initial entry to the container interior, the sealing or fastening means has been destroyed thereby preventing a repositioning of the trays to form the original container.

SUMMARY OF THE INVENTION

According to the practice of this invention, a container, particularly adapted for food items, is formed from two identical trays. Each tray is provided with a central wall bounded by four upstanding side walls substantially orthogonal to the central wall. Two opposite side walls of each tray are each provided with a generally horizontal flange, each flange being substantially parallel to the central wall of its respective tray. Each flange projects radially outwardly, as referred to the central portion of the tray. Each flange is provided with a layer of cohesive material which may extend over its entire area or which may extend over less than its entire area. A typical cohesive material (being a water based cold seal adhesive) is sold by Findley Co. of Wis. under the (trade mark) Nipweld. Further, the free edge of each flange may be provided with an ear which projects radially outwardly beyond the radial outward extent of an adjacent free edge portion of the flange. When the trays are placed together to form the container, a double thickness rib, defined by double thicknesses of the two flanges, is produced, with the arrangement being such that the flanges may be easily separated by peeling the flanges apart in opposite directions. Such peeling produces a force sufficient to overcome the cohesive force of the cohesive coating on each flange. After partial dispensing of its contents, the container may be reformed by placing the flanges in their original position, with the cohesive material again secured to itself on facing surfaces of opposite flanges. Cohesive material, after it has been applied in wet form to a substrate and dries, will not stick to most surfaces other than a similar cohesive surface. This feature is particularly advantageous in the packaging art where the trays or the cohesive coated blanks which form them sometimes contact each other and an adhesion or sticking between them would not be desired except when the trays are finally used for packaging a food product.

BRIEF DESCRIPTION OF THE DRAWINGS

FIG. 5 is a view similar to FIG. 1, and shows one flanged portion of a different blank for forming a tray according to this invention.

FIG. 6 is a view similar to FIG. 1 and shows one flanged portion of yet another blank for forming a tray.

DETAILED DESCRIPTION OF THE INVENTION

Figure 1:
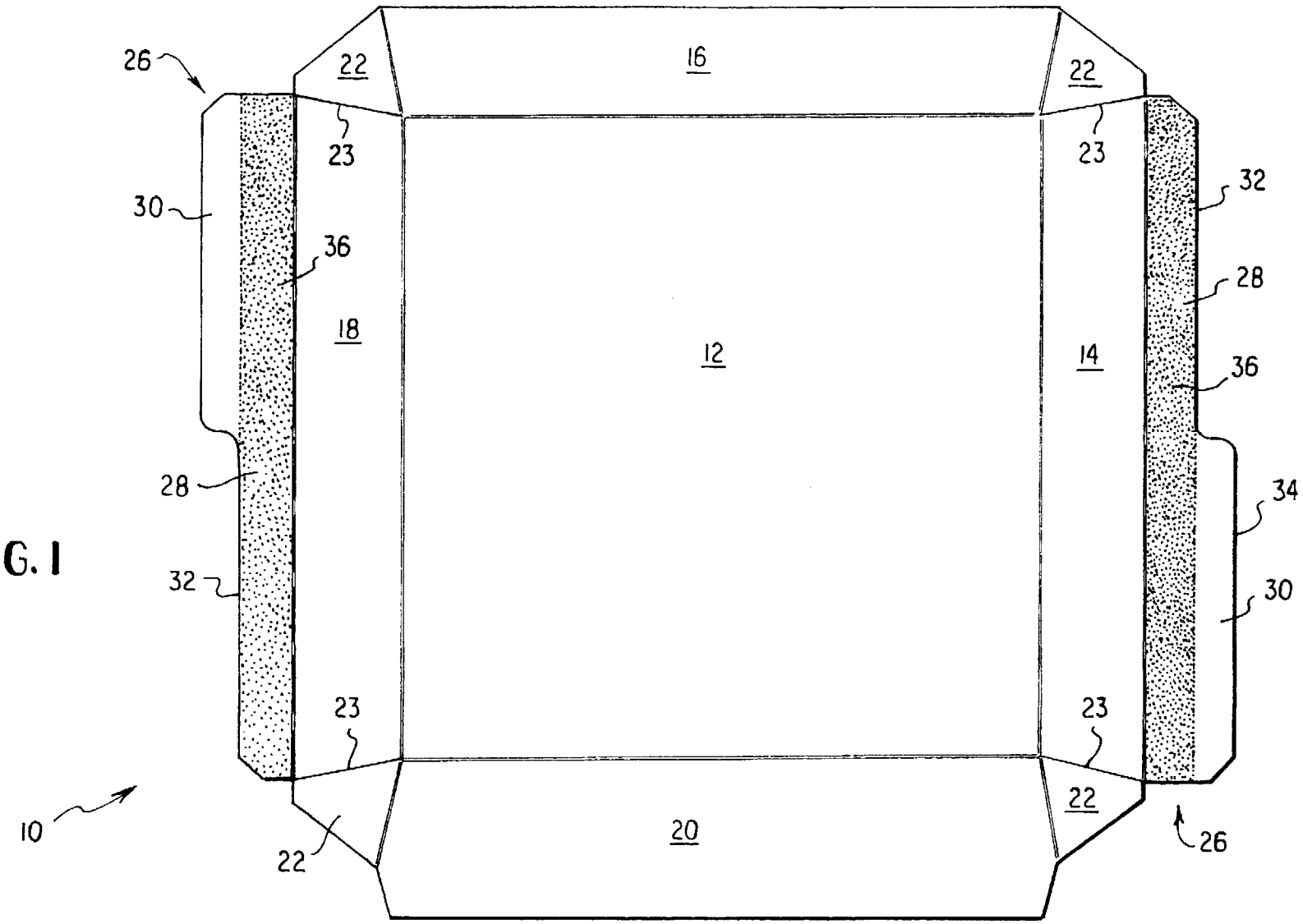
FIG. 1 is a plan view of a unitary paperboard blank from which the tray of this invention is fashioned.

Referring now to FIG. 1 of the drawings, a unitary blank 10 of paperboard or other stiff, resilient, and foldable sheet material is illustrated. The blank includes a central portion 12, shown as square, with side panels 14, 16, 18, and 20 integrally connected to the periphery of the central panel by the indicated fold lines. Side wall 20 is wider than opposite side wall 16. Corner connective flaps 22 are positioned at the upper and lower ends of side wall forming panels 16 and 20, with flaps 22 separated from adjoining side wall forming panels 14 and 18 by cut lines 23 extending completely through the paperboard. Flange forming panel portions 28 and 30 are coupled by the illustrated fold lines to respective side wall panels 14 and 18, with that portion of flanges 26 nearest to side respective wall panels 14 and 18, respectively, designated as 28. An integral ear 30 extends from portion 28 of each flange 26, with the flange free edges designated as 32 and 34. For convenience in description, portions 30 are termed ears and opposite side wall 16 and 20 are term unflanged side wall.

Figure 2:
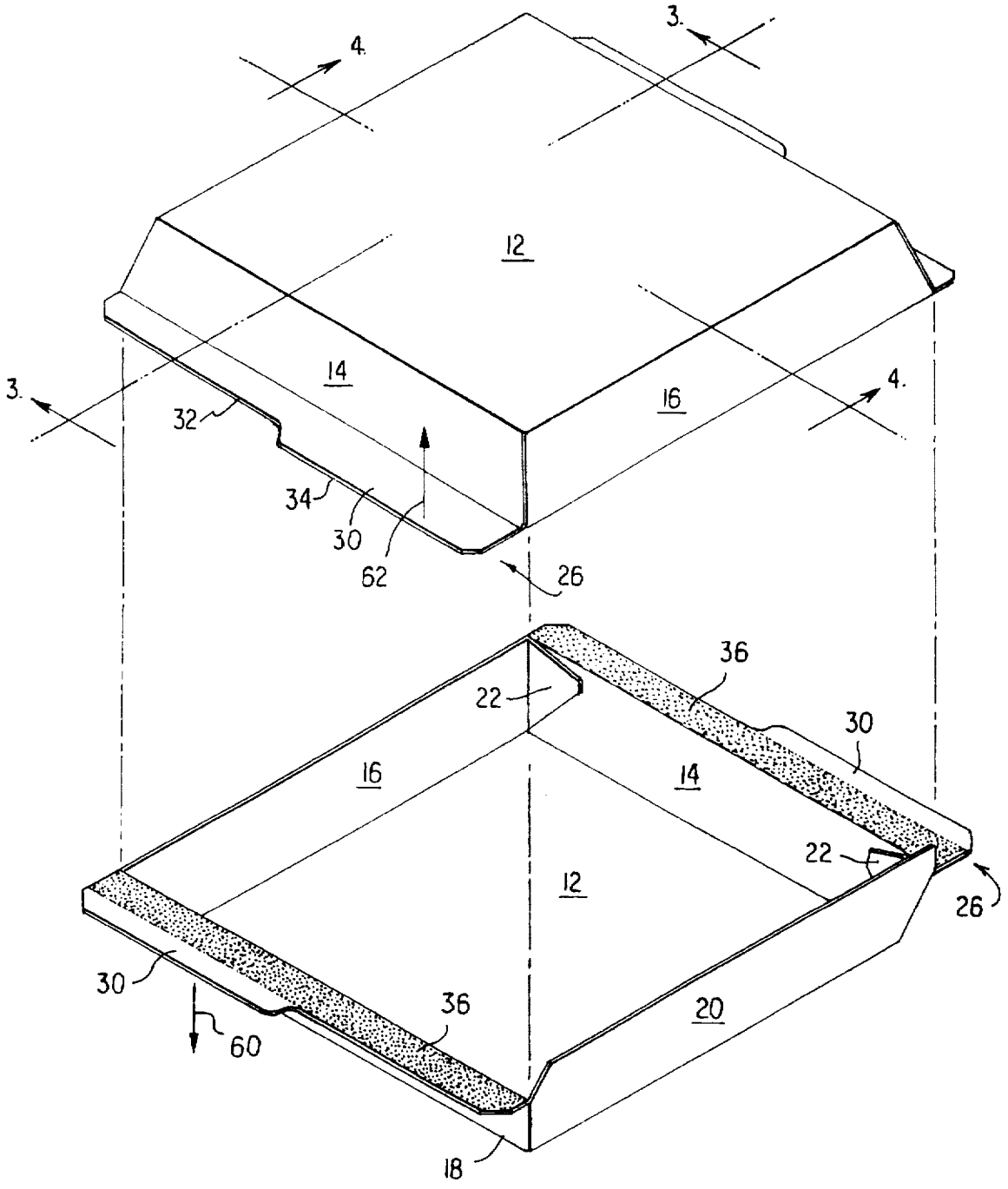
FIG. 2 is a perspective, exploded view showing two of the trays provided with cohesive material and placed together to form a container.

Referring now to FIG. 2, the blank of FIG. 1 has been folded about the indicated fold lines so as to assume the form illustrated at FIG. 2, with the blank of FIG. 1, after folding and gluing, being used to form both the top and the bottom tray of FIG. 2. It will be seen that joint flaps 22 have been glued or otherwise affixed to respective side walls 14 and 18. It is seen that the four side walls are substantially orthogonal to central panel 12, while flanges 26 project radially outwardly and horizontally from the tray, and are substantially parallel to central panel 12. Prior to the final erection or set-up shown at FIG. 2, those portions of flanges 26 which are nearest to respective side walls 14 and 18, and having an area the same as that of panel 28 of FIG. 1, are covered with a cohesive material 36, designated by stippling. If desired, the entire area of the flange may be coated with cohesive material.

Figure 3:
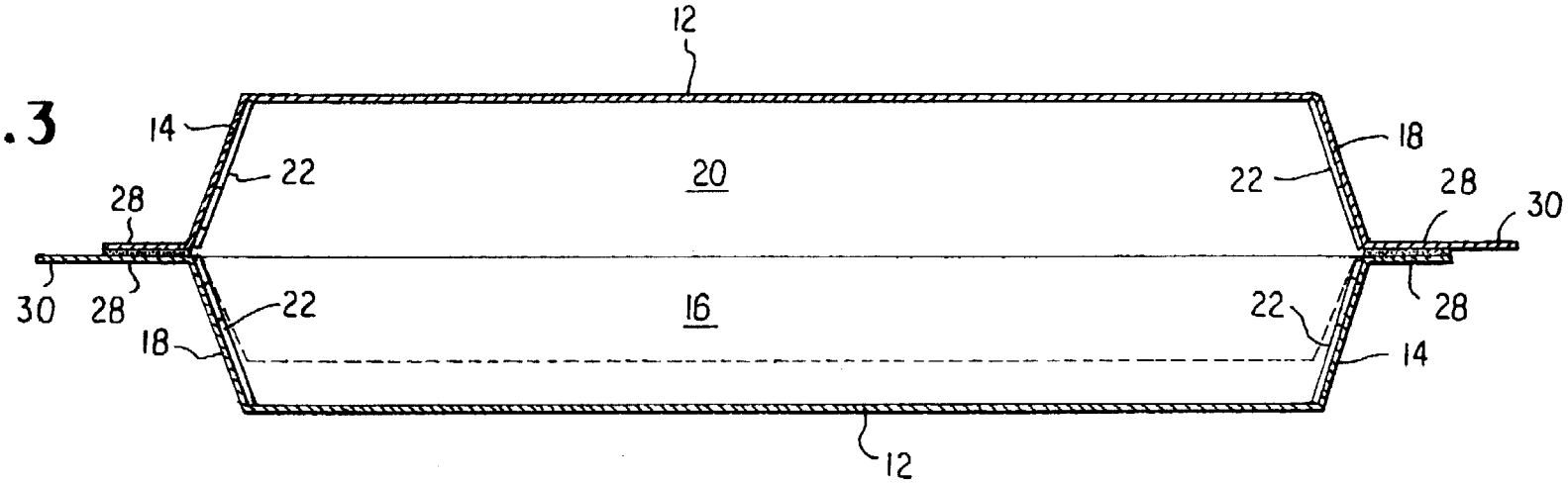
FIG. 3 is a view taken along section 3—3 of FIG. 2 when the trays have been placed together.
Figure 4:
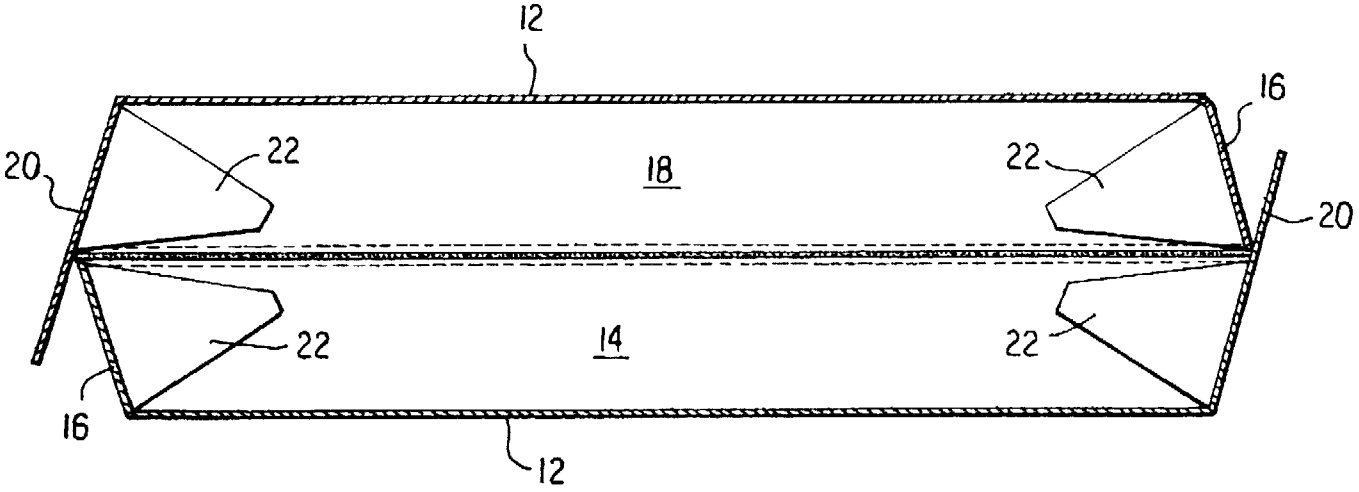
FIG. 4 is a view taken along section 4—4 of FIG. 2 after the trays have been placed together.

In use, two of the identical trays, as shown in FIG. 2, are placed one above the other, such that the narrower side wall 16 of one tray is opposite to and abuts the wider side wall 20 of the other tray. With a food product inside of the bottom tray, the top tray is moved downwardly from the position of FIG. 2, until respective cohesive areas 36 of the two trays are in registry. This relation is also shown at FIG. 3 wherein the stippled areas are shown as covering portions 28 (see FIG. 1) of each of the upper and lower flanges which together form a double thickness rim. The position shown at FIGS. 3 and 4 is the closed position, and it will be understood that in practice a food item (not shown) is within the container. In order to effect release between the trays, the user peels the flanges apart by exerting forces in opposite directions as shown by arrows 60 and 62 at FIG. 2. These forces are normal to the cohesive material 36 and are sufficient to separate each flange of each pair of flanges from the other. FIG. 4 also illustrates the overlapping of side wall panels 16 by panels 20.

Referring now to FIG. 5, a flanged portion of another blank, similar to that of FIG. 1, is illustrated, but wherein the flange is of a different form. In FIG. 5, flange 26 is defined by panel or section 40 nearest side wall 14, and by section 42 having a straight free edge 44. Panel or section 40 is provided with a layer of cohesive material 36, as indicated by the stippling. As shown, the cohesive area is of lesser width than the flanges, but it will be understood that the cohesive material may cover the entire area of the flanges. In operation, two trays each formed from the blank of FIG. 5 are placed together as in the manner shown at FIG. 2, with the cohesive areas 36 being in surface contact with each other. If section or zone 42 is not provided with cohesive, the user can more easily peel apart the flanges to effect opening.

Referring now to FIG. 6, yet another embodiment of a flange for a blank similar to that of FIG. 1 is shown, with section or panel 50 of flange 26 provided with cohesive material 36, as before. That portion 52 of flange 26 most remote from side wall 14 carries a free edge, the free edge consisting of a projecting ear portion 54, a recess portion 56, and straight portions 58. In use, two of the trays formed from the blank of FIG. 6 are placed together as in a manner similar to that indicated at FIG. 2, with their cohesive areas 36 in surface contact. The user now pushes in opposite directions on adjacent but laterally spaced pairs of ears 54 in order to effect separation of the trays, or may peel them apart by any other method. Similarly to the laterally displaced upper and lower ears 30 of either mating flange pair of FIG. 2, ears 54 are aligned laterally with corresponding recesses 56 of both of the two mating flanges of each flange pair.

I claims:

1. A paperboard container for the packaging of food products therein, said container formed of two trays, each of said two trays having a central wall and four side walls, each said side wall extending substantially orthogonally from a respective one of said central walls to thereby form said trays, a horizontal flange extending outwardly from respective two said side walls of each said tray, each said flange having two surfaces, each said flange having a free edge, each said flange having a layer of cohesive material on one of its said two surfaces, said container formed by placing two of said trays together, one on top of the other, with their respective cohesive layers, of respective pairs of flanges, in contact with each other, to thereby form a separable container which is separated by peeling said flanges apart in opposite directions normal to said flanges.

2. The container of claim 1 wherein said two trays are of identical construction.

3. The container of claim 2 wherein each said flange free edge is straight.

4. The container of claim 2 wherein each said free edge is curved so as to present laterally displaced ears at each flange pair.

5. The container of claim 4 wherein each said flange has a width, and wherein said cohesive layer extends over less than the entire width of each said flange.

6. The container of claim 3 wherein each said flange has a width, and wherein said cohesive layer extends over less than the entire width of each said flange.

7. The container of claim 1 wherein said two side walls are opposite side walls.

8. The paperboard container of claim 7 wherein said side walls of each said tray which do not have said flanges are unflanged and generally rectangular in form and are of different widths, whereby said unflanged side wall of each of said trays which is of lesser width is opposite to and abuts said unflanged side wall of each tray which is wider.

* * * * *